US006504795B1

(12) United States Patent
Niederer et al.

(10) Patent No.: US 6,504,795 B1
(45) Date of Patent: Jan. 7, 2003

(54) ARRANGEMENT OF MICROMECHANICAL ULTRASOUND TRANSDUCERS

(75) Inventors: Kurt Niederer, Eggenfelden (DE); Peter-Christian Eccardt, Ottobrunn (DE); Celine Merel, Marcellaz-Albanais (FR)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/573,918

(22) Filed: May 18, 2000

(30) Foreign Application Priority Data

May 19, 1999 (DE) ..... 199 22 965

(51) Int. Cl.[7] ..... H04R 17/00

(52) U.S. Cl. ..... 367/162; 367/163; 367/174; 367/176; 367/181

(58) Field of Search ..... 367/162, 163, 367/174, 176, 181; 310/324, 334, 340, 335

(56) References Cited

U.S. PATENT DOCUMENTS

| | | | | |
|---|---|---|---|---|
| 4,931,752 A | * | 6/1990 | Bray et al. | 310/313 D |
| 4,976,150 A | * | 12/1990 | Deka | 73/644 |
| 5,160,870 A | * | 11/1992 | Carson et al. | 310/324 |
| 5,331,062 A | * | 7/1994 | Sorathia et al. | 525/454 |
| 5,378,733 A | * | 1/1995 | Bates et al. | 521/54 |
| 5,406,163 A | * | 4/1995 | Carson et al. | 310/334 |
| 5,410,205 A | * | 4/1995 | Gururaja | 310/328 |
| 5,471,723 A | | 12/1995 | Lüder et al. | |
| 5,619,476 A | | 4/1997 | Haller et al. | |
| 5,870,351 A | | 2/1999 | Ladabaum | |
| 5,894,452 A | | 4/1999 | Ladabaum | |
| 5,982,709 A | | 11/1999 | Ladabaum et al. | |
| 6,004,832 A | | 12/1999 | Haller et al. | |
| 6,215,231 B1 | * | 4/2001 | Newnham et al. | 310/340 |

OTHER PUBLICATIONS

Suzuki; "A Silicon Electrostatic Ultrasonic Transducer"; 1989.

Kühnel et al.; "A Silicon Condenser Microphone With Structured Back Plate and Silicon Nitrade Membrane"; Nov. 12, 1991.

Haller et al.; "A Surface Micromachined Electrostatic Ultrasonic Air Transducer"; 1994.

Schindel et al.; "The Design and Characterization of Micromachined Air–Coupled Capacitance Transducers"; 01/95.

Eccardt; "Surface Micromachined Ultrasound Transducers in CMOS Technology"; 01/96.

Ladabaum et al.; "Silicon Micromachined Ultrasonic Immersion Transducer"; Oct. 1, 1996.

Eccardt et al.; "Micromachined Transducers for Ultrasound Applications"; 1997.

Eccardt; "Micromachined Ultrasound Transducers with Improved Coupling Factors from a CMOS Compatible Process"; 07/99.

Niederer et al.; "Micromachined Transducer Design for Minimized Generation of Surface Waves"; 10/99.

* cited by examiner

*Primary Examiner*—Ian J. Lobo

(57) ABSTRACT

The damping of membranes of ultrasound transducers in an arrangement occurs at the front side directly on the membranes by applying a polymer layer, whereby the working temperature dependent on the operating frequency of the ultrasound transducer lies within the glass transition range of the polymer layer.

20 Claims, 1 Drawing Sheet

ARRANGEMENT OF MICROMECHANICAL ULTRASOUND TRANSDUCERS

FIELD OF THE INVENTION

The present invention is related to an arrangement of micromechanically manufactured ultrasound transducers for emitting ultrasound in fluids or in biological tissue.

BACKGROUND OF THE INVENTION

Micromechanically manufactured ultrasound transducers are utilized for emission of ultrasound into fluids or into biological tissue. Such ultrasound transducers can be utilized individually or in an arrangement of a plurality of individual transducers. Each ultrasound transducer is composed of a micromechanical structure that comprises a membrane that is electrically excited in some way or other and emits ultrasound. Given an arrangement of ultrasound transducers, the area of the arrangement is large compared to the wavelength of the generated ultrasound. The membranes are small in diameter and much thinner than the wavelength of the emitted sound. Due to the extremely slight weight of the oscillating masses, i.e. the membranes, a micromechanical ultrasound transducer is in the position to emit and to receive short sound pulses with good efficiency.

What is disadvantageous about this arrangement is that the membranes reverberate a long time after a pulse and thereby emit slight sound. These oscillations are produced by waves that planarly propagate, i.e. not in the normal emission direction perpendicular to the membrane but in the planar expanse of an ultrasound arrangement or array of ultrasound transducers. Due to such decay oscillations of an arrangement of ultrasound transducers, the transmission and reception behavior is thus negatively influenced. Such oscillations are extremely unbeneficial since the frequency of the noise signal thereby emitted lies below the center frequency of the useful signal. The noise signal thus propagates better in the working medium than does the useful signal. Further, the decay oscillation of the transducer disturbs the reception of the sound pulse reflected from the subject under test given pulse-echo operation.

Conventional ultrasound transducers have larger oscillating masses and therefore the aforenoted problems do not exist. For generating short pulses, the useful oscillations and possible noise oscillations are attenuated to the same extent. The attenuation usually occurs by impedance-matched damping compounds at the backside (backing) or by inner attenuation of the thickness oscillator.

SUMMARY OF THE INVENTION

The invention is based on an object of damping noise signals occurring within an arrangement of ultrasound transducers that propagate in the direction of the planar expanse of the arrangement.

In an embodiment, an array of micromechanical ultrasound transducers is provided which comprises a plurality of transducers. The array has a front side. Each transducer comprises a membrane that is excited according to an electro-mechanical principle. The front side of the array comprises a damping layer that comprises a polymer material. An operating temperature of the array, given a predetermined operating frequency, is in the glass transition range of the polymer material.

In an embodiment, the damping layer has a thickness such that a corresponding Eigen-frequency of the damping layer corresponds to the operating frequency of the transducers.

In an embodiment, the thickness of the damping layer ranges from 10 to 50 $\mu$m.

In an embodiment, the polymer material is an elastomer.

In an embodiment, the elastomer is polyurethane or silicone.

In an embodiment, the transducers are arranged in the form of a rectangular matrix.

In an embodiment, the transducers are arranged in the form of a hexagonal matrix.

In an embodiment, the transducers are arranged in the form of a circular matrix.

In an embodiment, the transducers work according to an electrostatic principle and the membranes represent one of two capacitor electrodes.

In an embodiment, the transducers work according to a piezo-electric principle and the membranes represent a piezo-electric layer.

The damping of a membrane given a micromechanically manufactured ultrasound transducer cannot occur at the backside of the membrane since this is not freely accessible. Micromechanical ultrasound transducers are usually constructed in a hard carrier material, for example silicon, so that no damping parts are to be anticipated proceeding from this side. The invention is based on the perception that the membrane damping is possible from the front side on the basis of a layer of polymer material covering the entire field of the ultrasound transducer arrangement. The operating temperature of the ultrasound transducer system preferably lies in the temperature range of the glass transition temperature of the polymer material, whereby the temperature range of the glass transition is dependent on the operating frequency. Operating frequency and operating temperature are to be considered in common in order to determine the suitable polymer material, since the average temperature of the glass transition increases with the operating frequency. The glass transition range represents the temperature range wherein the polymer material converts from a solid into a soft state. In this state, the material has especially high shearing attenuation and a moderate compression attenuation. It is assured as a result thereof that a slight attenuation occurs in emission direction and an especially high shearing attenuation is present transversely relative to the emission direction.

It is advantageous given especially high operating frequencies in the megahertz range (MHZ) and given operating temperatures in the proximity of room temperature, to utilize an elastomer as polymer material.

For maximum attenuation of the undesired oscillations, the layer thickness of the polymer material is to be selected such that the membrane oscillation is in resonance with an oscillation of the coating at the operating frequency. This coating resonance is not a matter of a thickness oscillation as in the classic N4 adaptation. On the contrary, the coating oscillates parallel to the transducer surface between the membranes and the membrane interspaces. A coating manufactured according to these criteria deteriorates the amplitude and the duration of the useful signal only slightly, but effects an effective attenuation of the noise oscillations in lateral direction. It is especially advantageous to employ an elastomer such as polyurethane or silicone as damping layer. These materials have the required properties in order to damp noise oscillations between different ultrasound transducers of an arrangement.

Both capacitative ultrasound transducers as well as those that work according to the piezo-electrical principle can be damped.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
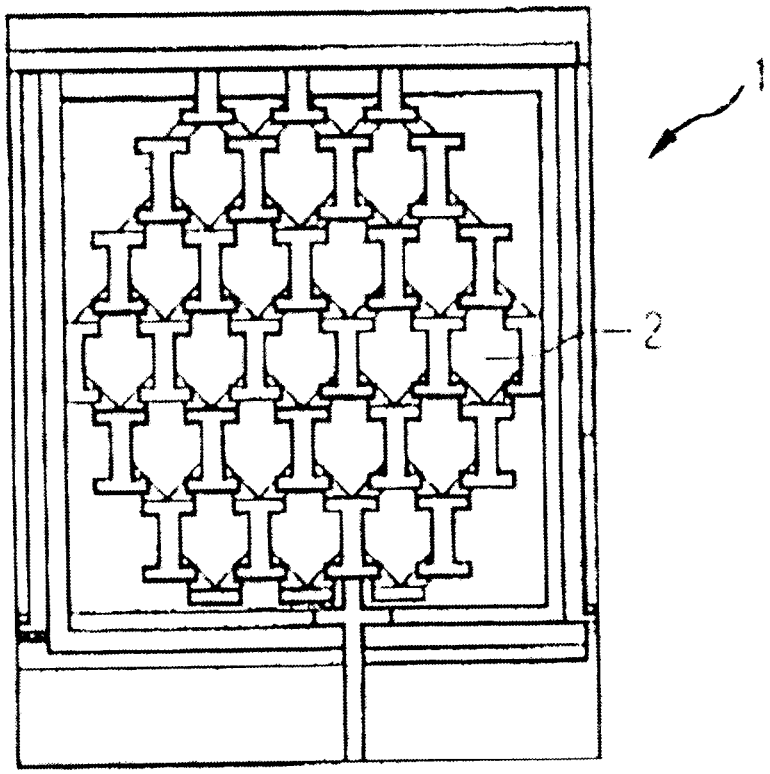
FIG. 1 is a plan view of an arrangement of ultrasound transducers made in accordance with the present invention.

The individual transducers 2 shown in FIG. 1 are disposed in a hexagonally structured arrangement. Due to the tightly packed arrangement of individual transducers 2, which were micromechanically manufactured, noise signals can occur between the individual transducers. As described above, the entire arrangement 1 is coated with a polymer layer. A high damping in the direction of the shearing waves occurring at a membrane of an ultrasound transducer is thus established, this propagating laterally, i.e. in planar direction of the arrangement. The shearing waves are usually transverse waves.

Figure 2:
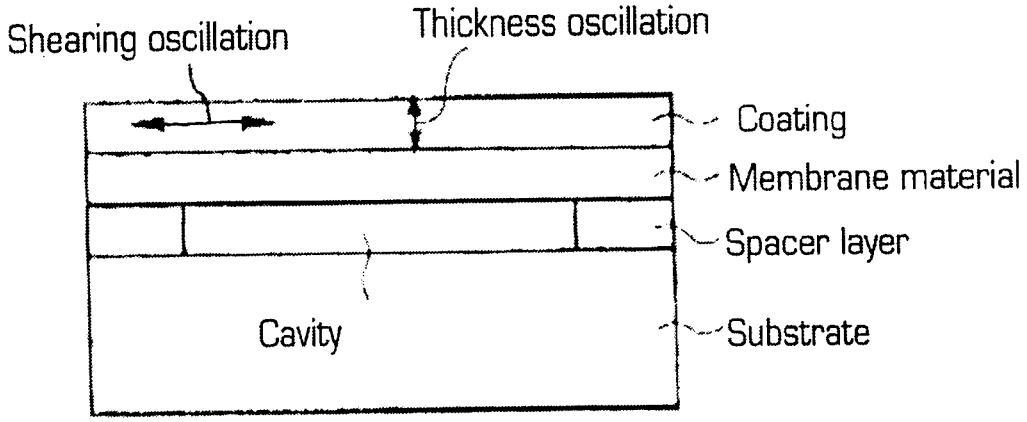
FIG. 2 is a cross-sectional view of an ultrasound transducer illustrating schematic position of the various layers and the appertaining oscillations.

FIG. 2 illustrates the structure of an individual ultrasound transducer. The air gap of this individual transducer lies between substrate and membrane. Its width is defined by the thickness of the spacer layer. A described coating is applied on the membrane, this absorbing oscillations caused by this or by neighboring transducers. In particular, the shearing oscillations identified with the horizontally disposed double arrow are damped by the coating when the coating exhibits the inventive properties.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An array of micromechanical ultrasound transducers comprising:

a plurality of transducers, each transducer comprising a membrane that is excited according to an electromechanical principle, the array having a front side, the front side of the array comprising a damping layer comprising a polymer material, an operating temperature of the array, given a predetermined operating frequency, being in the glass transition range of the polymer material.

2. The array of claim 1 wherein the damping layer has a thickness such that a corresponding Eigen-frequency of the damping layer corresponds to the operating frequency of the transducers.

3. The array of claim 2 wherein the thickness of the damping layer ranges from 10 to 50 $\mu$m.

4. The array of claim 1 wherein the polymer material is an elastomer.

5. The array of claim 4 wherein the elastomer is polyurethane or silicone.

6. The array of claim 1 wherein the transducers are arranged in the form of a rectangular matrix.

7. The array of claim 1 wherein the transducers are arranged in the form of a hexagonal matrix.

8. The array of claim 1 wherein the transducers are arranged in the form of a circular matrix.

9. The array of claim 1 wherein the transducers work according to an electrostatic principle, and the membranes represent one of two capacitor electrodes.

10. The array of claim 1 wherein the transducers work according to a piezoelectric principle and the membranes represent a piezo-electric layer.

11. An array of transducers for emitting ultrasound into fluids or biological tissue, the array comprising:

a plurality of transducers, each transducer having a front side and a backside, the front side associated with perpendicular emission of ultrasound; and a damping layer on the front side of the plurality of transducers, the damping layer having a thickness adapted to dampen shearing waves along the front side.

12. The array of claim 11 wherein the damping layer comprises a polymer material.

13. The array of claim 11 wherein each transducer comprises a membrane operable to emit ultrasound in response to electrical excitement, wherein the membrane is on the front side.

14. The array of claim 13 wherein the damping layer is on the membrane.

15. The array of claim 11 wherein each of the transducers comprise a piezo-electric transducer.

16. The array of claim 11 wherein the damping layer is 10 to 50 $\mu$m in thickness.

17. The array of claim 11 wherein an operating temperature of the plurality of transducers corresponds to a glass transition range of the damping layer.

18. An array of micromechanical ultrasound transducers for emitting ultrasound, the array comprising:

a plurality of micromechanical transducers, each of the micromechanical transducers having a substrate and a membrane, the membrane spaced from the substrate by a gap area; and a damping layer closer to the membrane than the substrate of each of the plurality of micromechanical transducers, the damping layer operable to provide a higher acoustic shearing attenuation than acoustic compression attenuation.

19. The array of claim 18 wherein the damping layer comprises an elastomer.

20. The array of claim 18 wherein a thickness of the damping layer ranges from 10 to 50 $\mu$m.

* * * * *